US007367781B2

(12) United States Patent
Gianchandani et al.

(10) Patent No.: US 7,367,781 B2
(45) Date of Patent: May 6, 2008

(54) PACKAGED MICROMACHINED DEVICE SUCH AS A VACUUM MICROPUMP, DEVICE HAVING A MICROMACHINED SEALED ELECTRICAL INTERCONNECT AND DEVICE HAVING A SUSPENDED MICROMACHINED BONDING PAD

(75) Inventors: Yogesh B. Gianchandani, Ann Arbor, MI (US); Shamus P. McNamara, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 839 days.

(21) Appl. No.: 10/751,695

(22) Filed: Jan. 5, 2004

(65) Prior Publication Data

US 2004/0179946 A1 Sep. 16, 2004

Related U.S. Application Data

(60) Provisional application No. 60/440,555, filed on Jan. 16, 2003.

(51) Int. Cl.
*F04B 37/06* (2006.01)

(52) U.S. Cl. ..... 417/48

(58) Field of Classification Search ..... 417/48, 417/50

See application file for complete search history.

(56) References Cited

U.S. PATENT DOCUMENTS 5,375,979 A * 12/1994 Trah ..... 417/52
5,871,336 A 2/1999 Young
6,136,212 A * 10/2000 Mastrangelo et al. ..... 216/49
6,531,417 B2 * 3/2003 Choi et al. ..... 216/2
6,533,554 B1 3/2003 Vargo et al.
2001/0003572 A1 6/2001 Bernard et al.
2002/0144738 A1 10/2002 Unger et al.

FOREIGN PATENT DOCUMENTS

EP 1 107 292 A 6/2001

OTHER PUBLICATIONS

Miller, R.A., et al., A MEMS Radio-Frequency Ion Mobility Spectrometer For Chemical Vapor Detection, Sensors and Actuators A 91, 2001, pp. 301-312.
Wilson, Chester G., et al., Silicon Micromachining Using In Situ DC Microplasmas, Journal of Microelectromechanical Systems, vol. 10, No. 1, Mar. 2001, pp. 50-54.

(Continued)

*Primary Examiner*—Michael Koczo, Jr.
(74) *Attorney, Agent, or Firm*—Brooks Kushman P.C.

(57) ABSTRACT

A number of micromachined devices including a micromachined pump for on-chip vacuum is provided. For example, a single-chip micromachined implementation of a Knudsen pump having one or more stages and which uses the principle of thermal transpiration with no moving parts is provided. A six-mask microfabrication process to fabricate the pump using a glass substrate and silicon wafer is shown. The Knudsen pump and two integrated pressure sensors occupy an area of 1.5 mm×2 mm. Measurements show that while operating in standard laboratory conditions, this device can evacuate a cavity to 0.46 atm using 80 mW input power. High thermal isolation is obtained between a polysilicon heater of the pump and the rest of the device.

32 Claims, 3 Drawing Sheets

OTHER PUBLICATIONS

Iza, F., et al., Influence of Operating Frequency And Coupling Coefficient On The Efficiency of Microfabricated Inductively Coupled Plasma Sources, Institute of Physics Publishing, Plasma Sources Science and Technology, 11, 2002, pp. 1-7.

Wilson, Chester G., et al., Spectral Detection of Metal Contaminants in Water Using an On-Chip Microglow Discharge, IEEE Transactions on Electron Devices, vol. 49, No. 12, Dec. 2003, pp. 2317-2322.

Hobson, J.P., et al., Review of Pumping by Thermal Molecular Pressure, J. Vac. Sci. Technol. A 18(4), Jul./Aug. 2000, pp. 1758-1765.

Hobson, J.P., Accomodation Pumping—A New Principle For Low Pressures, Journal of Vacuum Science and Technology, vol. 7, No. 2, 1970, pp. 351-357.

Tracy, D.H., Thermomolecular Pumping Effect, J. Phys. E: Sci. Instr., 7, 533, 1974.

Muntz, E. Phillip, et al., The MEMS Handbook, Chaper 29, Microscale Vacuum Pumps, 2002, pp. 29-1-29-26.

Turner, D.J., A Mathematical Analysis of A Thermal Transpiration Vacuum Pump, Edwards High Vacuum International Ltd., vol. 16., No. 8, Sussex, Great Britain, pp. 413-417.

Wong, C. Channy, et al., Gas Transport By Thermal Transpiration In Micro-Channels—A numerical Study, DSC, vol. 66, MEMS, 1998, pp. 223-230.

Young, Robert M., Analysis of a Micromachine Based Vacuum Pump on a Chip Actuated By The Thermal Transpiration Effect, J. Vac. Sci. Technol. B 17(2), Mar./Apr. 1999, pp. 280-287.

Vargo, S.E., et al., Knudsen Compressor as a Micro-and Macroscale Vacuum Pump Without Moving Parts or Fluids, J. Vac. Sci. Technol. A 17(4), Jul./Aug. 1999, 1999 American Vacuum Society, pp. 2308-2313.

Vargo, S. E., et al., Initial Results From The First MEMS Fabricated Thermal Transpiration-Driven Vacuum Pump, 22nd International Symposium on Rarefied Gas Dynamics, Sydney, Australia, Jul. 2000, p. 1-2.

McNamara, Shamus, et al., A Fabrication Process with High Thermal Isolation and Vacuum Sealed Lead Transfer For Gas Reactors and Sampling Microsystems, Proceedings IEEE, Sixth Annual International Conference on MicroElectro Mechanical Systems, 2003, pp. 646-649.

McNamara, Shamus, et al., A Micromachined Knudsen Pump For On-Chip Vacuum, Digest of Technical Papers of the 12th International Conference on Solid-State Sensors, Actuators & Microsystems, Boston, MA, Transducers Jun. 2003, pp. 1919-1922.

Zhang, Chunbo, et al., An Integrated Combustor-Thermoelectric Micro Power Generator, Technical Digest, 12th IEEE Conf. on Solid-State Sensors and Actuators, Transducers 2001, Munich, Germany, pp. 34-37, Jun. 10-14, 2001.

Zang, Chunbo, et al., Fabrication of Thick Silicon Dioxide Layers Using Drie, Oxidation and Trench Refill, Technical Digest, IEEE 2002 Int. Conf. on Micro Electro Mechanical Systems, MEMS 2002, Las Vegas, pp. 160-163, Jan. 2002.

Yu, Conrad M., et al., High Performance Hand-Held Gas Chromatograph, ASME Proc. of Microelectromechanical Systems, MEMS, 1998, Anaheim, CA, Abstract.

Cheng, Y.T., et al., Vacuum Packaging Technology Using Localized Aluminum/Silicon-to-Glass Bonding, Proc. IEEE Intl. MEMS-Conf., 2001, Interlaken, Switzerland, pp. 18-21.

Chavan, Abhijeet V., et al., Batch-Processed Vacuum-Sealed Capacitive Pressure Sensors, J. Microelectromechanical Systems, vol. 10(4), 2001, pp. 580-588.

* cited by examiner

PACKAGED MICROMACHINED DEVICE SUCH AS A VACUUM MICROPUMP, DEVICE HAVING A MICROMACHINED SEALED ELECTRICAL INTERCONNECT AND DEVICE HAVING A SUSPENDED MICROMACHINED BONDING PAD

CROSS-REFERENCE TO RELATED APPLICATION

This application claims the benefit of U.S. provisional application Ser. No. 60/440,555, filed Jan. 16, 2003.

STATEMENT REGARDING FEDERALLY SPONSORED RESEARCH OR DEVELOPMENT

This invention was made with Government support under Award No. EEC-9986866 from the Engineering Research Centers Program of the NSF. The Government has certain rights in the invention.

BACKGROUND OF THE INVENTION

1. Field of the Invention

This invention relates to packaged micromachined devices such as vacuum micropump devices, devices having a micromachined sealed electrical interconnect and devices having a suspended micromachined bonding pad.

2. Background Art

The following references are noted herein:

[1] R. A. Miller et al., "A MEMS Radio-Frequency Ion Mobility Spectrometer for Chemical Vapor Detection," SENS. ACTUA., A91, 301 (2001).

[2] C. Wilson et al., "Silicon Micro-machining Using In-Situ DC Microplasmas," J. MICROELECTROMECH. SYST., 10(1), 50 (2001).

[3] F. Iza et al., "Influence of Operating Frequency and Coupling Coefficient on the Efficiency of Microfabricated Inductively Coupled Plasma Sources," PLASMA SOURCES SCI. TECHNOL., 11, 1 (2002).

[4] C. G. Wilson et al., "Spectral Detection of Metal Contaminants in Water Using an On-Chip Microglow Discharge," IEEE TRANSACTIONS ON ELECTRON DEVICES, 49(12), 2317-2322 (2002).

[5] J. P. Hobson et al., "Review of Pumping by Thermal Molecular Pressure," J. VAC. SCI. TECHNOL., A18 (4), 1758 (2000).

[6] M. Knudsen, ANNALS DER PHYSIK, 31, 205 (1910).

[7] J. P. Hobson, "Accommodation Pumping—A New Principle," J. VAC. SCI. TECHNOL., 7(2), 351 (1970).

[8] D. H. Tracey, "Thermomolecular Pumping Effect," J. PHYS. E: SCI. INSTR., 7, 533 (1974).

[9] E. P. Muntz et al., "Microscale Vacuum Pumps," THE MEMS HANDBOOK, M. Gad-el-Hak, Ed. (CRC Press, Boca Raton, 2002), Chap. 29.

[10] D. J. Turner, "A Mathematical Analysis of a Thermal Transpiration Vacuum Pump," VACUUM 16(8), 413 (1966).

[11] C. C. Wong et al., "Gas Transport by Thermal Transpiration in Micro-Channels—A Numerical Study," PROCEEDINGS ASME MEMS CONFERENCE, DSC-Vol. 66 (Anaheim, Calif., 1998), pp. 223-228.

[12] R. M. Young, "Analysis of a. Micromachine Based Vacuum Pump on a Chip Actuated by the Thermal Transpiration Effect," J. VAC. SCI. TECHNOL., B17 (2), 280 (1999).

[13] S. E. Vargo et al., "Knudsen Compressor as a Micro- and Macroscale Vacuum Pump Without Moving Parts or Fluids," J. VAC. Sci. TECHNOL., A17(4), 2308 (1999).

[14] S. E. Vargo et al., "Initial Results From the First MEMS Fabricated Thermal Transpiration-Driven Vacuum Pump," RAREFIED GAS DYNAMICS: 22ND INTL. SYMP., p. 502 (2001).

[15] E. Kennard, "Kinetic Theory of Gases," (McGraw Hill, New York, 1938).

[16] S. McNamara et al., "A Fabrication Process with High Thermal Isolation and Vacuum Sealed Lead Transfer for Gas Reactors and Sampling Microsystems," PROCEEDINGS IEEE THE SIXTH ANNUAL INTERNATIONAL CONFERENCE ON MICRO ELECTRO MECHANICAL SYSTEMS, (IEEE 2003), pp. 646-649.

[17] S. McNamara et al., "A Micromachined Knudsen Pump for On-Chip Vacuum," DIGEST OF TECHNICAL PAPERS OF THE 12TH INTERNATIONAL CONFERENCE ON SOLID-STATE SENSORS AND ACTUATORS, 2003, pp. 1919-1922.

Micromachined gas pumps have a variety of potential applications, ranging from actuation of gases for gas chromatography, spectroscopy [1], or microplasma manufacturing [2,3], to the pneumatic actuation of liquids for lab-on-a-chip and chemical sensing devices [4]. Conventional vacuum pumps scale down poorly due to increased surface-to-volume ratio and have reliability concerns due to the relative increase of frictional forces over inertial forces at the microscale. Thermal molecular pumps can potentially overcome these challenges. There are three types of thermal molecular pumps [5]: the Knudsen pump [6], the accommodation pump [7], and the thermomolecular pump [8]. The Knudsen pump exploits the temperature dependence of molecular flux rates through a narrow tube; the accommodation pump exploits the temperature dependence of the tangential momentum accommodation coefficient (TMAC) of gases; whereas the thermomolecular pump exploits some materials that violate the cosine scattering law when heated.

The Knudsen pump provides the highest compression ratio and, unlike the other two pumps, its performance is independent of the material and surface conditions, which can be difficult to characterize and control. A miniaturized Knudsen pump also has a high theoretical efficiency when compared to conventional vacuum pumps [9] and scales well to small dimensions because the efficiency improves as the surface-to-volume ratio increases. It offers potentially high reliability because there are no moving parts, but power consumption can be a major concern because of the elevated temperatures required.

The Knudsen pump was first reported in 1910 and since then has been reported approximately once per decade [10]. Despite its attractive features, persistent challenges that have prevented its widespread adoption include the need for sub-micron dimensions to operate at atmosphere (and consequently it was always confined to high vacuum operation over a limited pressure range) and low throughput. The past decade has witnessed greater activity, with simulation efforts [11,12] and a partially micromachined implementation achieving a best-case pressure drop of 11.5 Torr using helium [13,14].

The Knudsen Pump Theory

The principle of thermal transpiration [15], on which the Knudsen pump is based, describes the pressure-temperature relationship between two adjacent volumes of gas at different temperatures. If these two volumes of gas are separated by a channel or aperture that permits gas flow only in the free molecular regime (FIG. 1), they settle at different pressures, the ratio of which is a function of only temperature. The temperature difference does not create a pressure difference between the chambers with a channel that permits viscous flow.

The following patent references are related to the present invention: U.S. Pat. Nos. 6,533,554 and 5,871,336 and published U.S. patent application Ser. No. 2001/0003572.

The following references are also noted herein:

[A] C. Zhang et al., "An Integrated Combustor-Thermoelectric Micro Power Generator," TECHNICAL DIGEST, DIGEST, TWELFTH IEEE CONF. ON SOLID-STATE SENSORS AND ACTUATORS (Transducers '01), Munich, Germany, pp. 34-37, June 2001.

[B] C. Zhang et al., "Fabrication of Thick Silicon Dioxide Layers Using DRIE, Oxidation and Trench Refill," TECHNICAL DIGEST, IEEE 2002 INT. CONF. ON MICRO ELECTRO MECHANICAL SYSTEMS, (MEMS 2002), Las Vegas, pp. 160-163, January 2002.

[C] C. M. Yu et al., "A High Performance Hand-Held Gas Chromatograph," ASME PROC. OF MICROELECTROMECHANICAL SYSTEMS, (MEMS), 1998, Anaheim, Calif., pp. 481-6.

[D] Y. T. Cheng et al., "Vacuum Packaging Technology Using Localized Aluminum/Silicon-to-Glass Bonding," PROC. IEEE INTL. MEMS CONF., 2001, Interlaken, Switzerland, pp. 18-21.

[E] A. V. Chavan et al., "Batch-Processed Vacuum-Sealed Capacitive Pressure Sensors," J. MICROELECTROMECHANICAL SYSTEMS, v. 10(4), 2001, pp. 580-588.

In recent years, there has been substantial interest in developing gas-handling Microsystems that can serve as reactors, combustors, and detectors such as mass spectrometers [A-C]. These systems, which may also integrate pumps, reservoirs, flow sensors, and pressure sensors, often operate at elevated temperatures and require high thermal isolation for energy efficiency and minimization of cross-talk. In addition, when capacitive transducers are used, a vacuum-sealed lead transfer with low parasitic capacitance is a significant asset. While there have been strong efforts on vacuum micropackaging [D] and sealed lead transfer [E], research has not been directed at simultaneously achieving high thermal isolation and sub-femtofarad parasitic capacitance.

For many transducers that operate in vacuum, the ability to create and control vacuum within an on-chip cavity promises enhanced performance, longer lifetime, and simplified packaging. While locally heated getter materials can maintain a vacuum in microcavities, as described in published U.S. patent application Ser. No. 2003/0089394, they are unsuitable for systems that continuously sample gases.

SUMMARY OF THE INVENTION

An object of the present invention is to provide a number of improved micromachined devices including a packaged micromachined device such as a vacuum micropump, a device having a micromachined sealed electrical interconnect and a device having a suspended micromachined bonding pad.

In carrying out the above object and other objects of the present invention, a packaged micromachined device including at least one narrow microfluidic channel having a small hydraulic diameter is provided. The device includes a substrate having an inner surface and a substrate cover having inner and outer surfaces attached to the substrate. The device also includes at least one micromachined layer located between the inner surfaces to form the micromachined device including the at least one narrow microfluidic channel having the small hydraulic diameter when the substrate and the substrate cover are attached together.

The micromachined device may include a micropump having at least one stage.

The hydraulic diameter may be sized so that the at least one narrow microfluidic channel operates in either a free molecular flow regime or a viscous flow regime.

The at least one narrow microfluidic channel may be sized to operate at atmospheric pressure.

The micropump may be a thermal transpiration micropump.

The device may further include a plurality of sealed microchambers including first and second microchambers, and the at least one narrow microfluidic channel may communicate the first and second microchambers. The micromachined device may further include at least one micromachined structure for creating a temperature difference between first and second ends of the at least one narrow microfluidic channel in order to generate a pumping effect.

The at least one micromachined structure may include a heater suspended adjacent a first end of the at least one narrow microfluidic channel and thermally isolated from the substrate.

The heater may be an electrically conductive heater suspended from the substrate cover.

A plurality of narrow microfluidic channels may fluidly communicate the sealed first and second microchambers.

The substrate may be a thermally insulating substrate for thermally isolating the micromachined device.

The device may further include a microsensor disposed adjacent the first microchamber.

The microsensor may be a pressure sensor to sense pressure in the first microchamber.

The pressure sensor may be a capacitive pressure sensor at least partially disposed in one of the sealed microchambers.

The sealed microchambers may include a third microchamber and a wide microfluidic channel fluidly communicating the third microchamber and the first microchamber. The first, second and third microchambers and the wide and narrow microfluidic channels may define a stage of the micropump.

Pressure may be lowered in the at least one narrow microfluidic channel due to thermal transpiration, and pressure may remain substantially constant in the wide microfluidic channel.

The micropump may be a vacuum micropump.

Two micromachined layers having different thicknesses may be located between the inner surfaces. The two micromachined layers and the inner surface of the substrate may define a plurality of narrow microfluidic channels.

Structures forming the at least one microfluidic channel may be either <5 μm thick or have <10 W/mK thermal conductivity.

The device may further include a microsensor disposed adjacent the third microchamber.

The microsensor may be a pressure sensor to sense pressure in the third microchamber.

The pressure sensor may be a capacitive pressure sensor at least partially disposed in one of the sealed microchambers.

The capacitive pressure sensor may include a bottom electrode supported on the substrate and a top electrode formed from the at least one micromachined layer and suspended adjacent the bottom electrode.

The substrate cover may be an insulating substrate cover, and may include a first hole formed therethrough between the inner and outer surfaces of the substrate cover and a first path of electrically conductive material electrically connecting the outer surface of the substrate cover to the micromachined device through the first hole.

The micromachined device may include a heater, and the electrically conductive material may electrically connect the heater and the outer surface of the substrate cover through the first hole.

The substrate cover may include a second hole formed therethrough between the inner and outer surfaces of the substrate cover and a second path of electrically conductive material. The device may further include a microsensor, and the second path of electrically conductive material may electrically connect the microsensor and the outer surface of the substrate cover through the second hole.

The substrate cover may include at least one dielectric layer.

The device may further include a second micromachined structure located within one of the sealed microchambers. The substrate cover may be an insulating substrate cover which includes at least one hole formed therethrough between the inner and outer surfaces of the substrate cover and a path of electrically conductive material electrically connecting the second micromachined structure with the outer surface of the substrate cover through the at least one hole.

The device may further include an electrically conductive layer formed on the outer surface of the substrate cover. The first path of electrically conductive material electrically connects the electrically conductive layer to the micromachined device.

The dielectric substrate cover may thermally isolate the electrically conductive layer and may reduce parasitic capacitance.

The at least one micromachined layer may also bond the substrate cover to the substrate.

The at least one micromachined layer may anodically bond the substrate cover to the substrate.

The at least one micromachined layer may form part of a microsensor.

The at least one micromachined layer may be electrically conductive.

Further in carrying out the above object and other objects of the present invention, a device having a micromachined sealed electrical interconnect is provided. The device includes a substrate having an inner surface and an insulating substrate cover having inner and outer surfaces attached to the substrate to form a sealed cavity. The substrate cover includes a first hole formed therethrough between the inner and outer surfaces of the substrate cover and a first path of electrically conductive material sealingly connecting the outer surface of the substrate cover to the cavity through the first hole to form the micromachined sealed electrical interconnect.

The interconnect may have a resistance less than 5 ohms and may have a capacitance to any other electrically conductive structure of the device totaling less than 100 fF.

The insulating substrate cover may be substantially planar.

The substrate may be substantially planar.

The device may further include an electrically conductive layer formed on the outer surface of the substrate cover. The path of electrically conductive material electrically connects the electrically conductive layer to the cavity.

The electrically conductive layer may be metallic. The first path of electrically conductive material may include doped polysilicon. The insulating substrate cover may include at least one dielectric layer.

The device may further include an upper electrical conductor located outside of the cavity and a lower electrical conductor located within the cavity. The first path of electrically conductive material may electrically connect the upper and lower electrical conductors together.

The upper electrical conductor may be metallic. The first path of electrically conductive material may include doped polysilicon. The insulating substrate cover may include at least one dielectric layer, and the lower electrical conductor may be metallic.

Still further in carrying out the above object and other objects of the present invention, a device having a suspended micromachined bonding pad is provided. The device includes a substrate having an inner surface and an insulating substrate cover having inner and outer surfaces. The substrate cover is attached to the substrate at an attachment area to form a vacuum or gas-filled cavity. The device also includes a planar electrical conductor formed on the upper surface of the substrate cover to form the bonding pad for electrical contact with a bonding wire or probe. The device further includes a spacer layer supporting the substrate cover on the substrate about the cavity at the attachment area.

The planar electrical conductor may be metallic. The substrate cover may include at least one dielectric layer. The spacer layer may be electrically conductive.

The device may further include an electrical interconnect sealed within the substrate cover and electrically connected to the planar electrical conductor.

The planar electrical conductor may be electrically connected to the electrical interconnect while minimizing eliminating overlap with other electrical conductors of the device.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
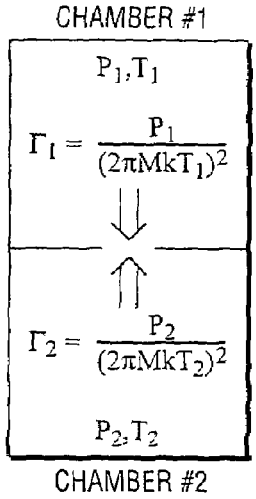
Fig. 1 (PRIOR ART)
FIG. 1 is a schematic view which illustrates the principle of thermal transpiration which states that two chambers at differing temperatures generate a pressure differential due to differences in the rate of molecular flux from either chamber.
Figure 2:
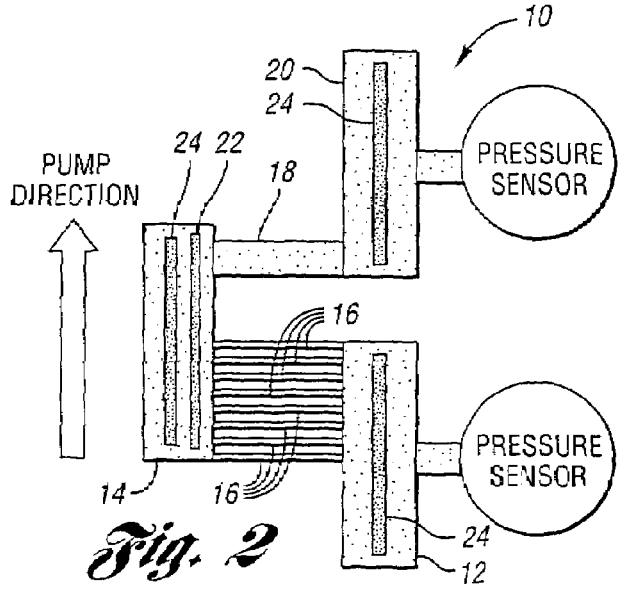
FIG. 2 is a top schematic view of a micromachined device such as a Knudsen pump of the present invention showing two cold chambers, one hot chamber, a wide channel and parallel narrow channels; attached to each cold chamber is a pressure sensor, and at the bottom of every chamber is a bolometer.
Figure 3A:
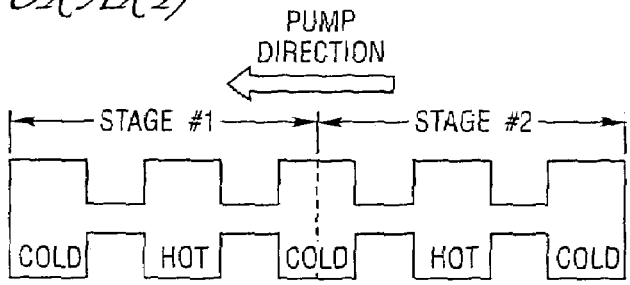
FIG. 3*a* is a schematic view of a multi-stage Knudsen pump of the present invention.

Referring again to the drawing figures, a micromachined device such as a Knudsen pump (generally indicated at 10 in FIG. 2) of the present invention creates a pressure increase from a cold region or chamber 12 to a hot region or chamber 14 through at least one and preferably a plurality of very narrow channels 16 in which the gas is in the free molecular flow regime. Then a wide channel 18 is used to transport the gas in the viscous flow regime from the hot chamber 14 to a second cold region or chamber 20. A heater 22 is located in the hot chamber 14 and bolometers 24 are located in the chambers 12, 14 and 20. A lower pressure may be obtained by cascading multiple stages in series as shown in FIG. 3*a*. The ratio of the pressures may be calculated by equating the flux of gas molecules passing through the channel or aperture:

$$\Gamma = \frac{n\,\upsilon_{ave}}{4} \tag{1}$$

where $$P = nkT \tag{2}$$

$$\upsilon_{ave} = \left(\frac{8kT}{\pi M}\right)^{1/2} \tag{3}$$

$\Gamma$ is the flux of gas molecules going through the aperature, $v_{ave}$ is the average velocity of the gas molecules, n is the gas number density, P is pressure, k is Boltzmann's constant, T is temperature, and M is the mass of a gas molecule. Combining these equations, the attainable pressure ($P_{vac}$) as a function of hot stage temperature ($T_h$), cold stage temperature ($T_c$), the outlet pressure ($P_{outlet}$) and the number of stages (s) is:

$$P_{vac} = P_{outlet}\left(\frac{T_c}{T_h}\right)^{s/2} \tag{4}$$

Figure 3B:
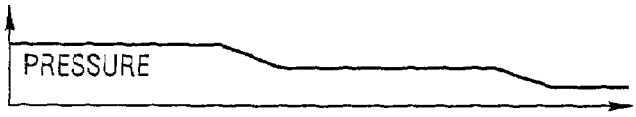
FIGS. 3*b* and 3*c* are graphs of temperature and pressure, respectively, which correspond to and show the operation of the pump of FIG. 3*a*; the pressure is lowered in the narrow channels because of thermal transpiration; in the wide channels, thermal transpiration does not take place and the pressure remains substantially constant.
Figure 3C:
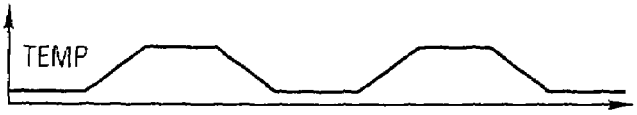
Figure 4:
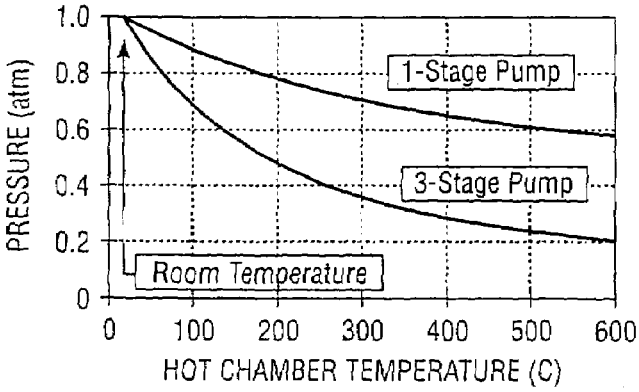
FIG. 4 is a graph of pressure v. hot chamber temperature which shows theoretical performance of the Knudsen pump of the present invention as a function of hot chamber temperature and number of stages; to obtain this graph, the cold chamber is held constant at room temperature.

FIG. 3*a* shows a schematic of the operation of a Knudsen pump having multiple stages. The temperature profile of FIG. 3*c* shows that the hot chambers are at an elevated temperature and that the channels (wide and narrow) have a thermal gradient along their length. The pressure is constant except through a narrow channel, as shown in FIG. 3*b*, where thermal transpiration causes a pressure gradient. FIG. 4 shows the theoretical performance of a Knudsen pump operating with the cold chamber held at room temperature.

With regard to achieving the proper flow regime in the channels, it is helpful to use the Knudsen number as a guideline. The Knudsen number is defined as $Kn=\lambda/l$, where $\lambda$ is the mean free path of the gas and l is the hydraulic diameter of the channel. Ideally, the narrow channels should have a hydraulic diameter less than 1/10 of the "mean free path of the gas" (i.e., for free molecular flow, $Kn>10$) and the wide channels should have a hydraulic diameter greater than 20 times the "mean free path of the gas" (i.e., for viscous flow, $Kn<0.05$). However, both types of channels may be operated in the transition flow regime ($0.05<Kn<10$) with a possible loss of compression. Thus, the maximum operating pressure is increased by minimizing the hydraulic diameter of the narrow channels, whereas the lowest attainable pressure (best vacuum) is enhanced by maximizing the hydraulic diameter of the wide channels.

Experimental Device

Figure 5A:
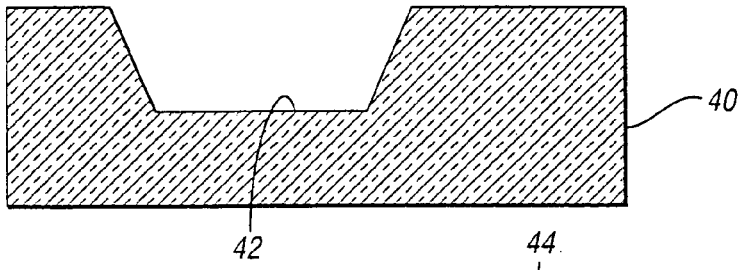
FIGS. 5*a*-5*f* are side schematic views illustrating the fabrication steps used to create the Knudsen compressor or pump and capacitive pressure sensors of the present invention.

As shown in FIGS. 5*a*-5*g*, a six-mask fabrication process is used to co-fabricate the Knudsen pump and capacitive pressure sensors [16]. A Cr/Au mask is evaporated onto a Borofloat® glass wafer or substrate 40 and patterned. Recesses 42 10 μm deep are formed by a wet etch in $HF:HNO_3:H_2O$ 7:3:10; which produces sloping sidewalls to facilitate metallization. These recesses define the hot and cold chambers 14 and 12, 20, respectively, the capacitive pressure sensor cavity, and the wide channels 18 (FIG. 5*a*).

Figure 5B:
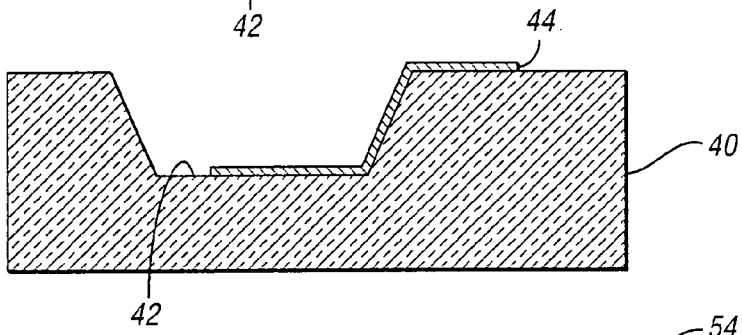

Titanium is sputtered and patterned to define the bolometers 24 and lower electrode 44 of the capacitive pressure sensor at the bottom of the recess 42, but the titanium extends to the top of the glass substrate 40 to permit electrical contact in a subsequent step (FIG. 5*b*).

Figure 5C:
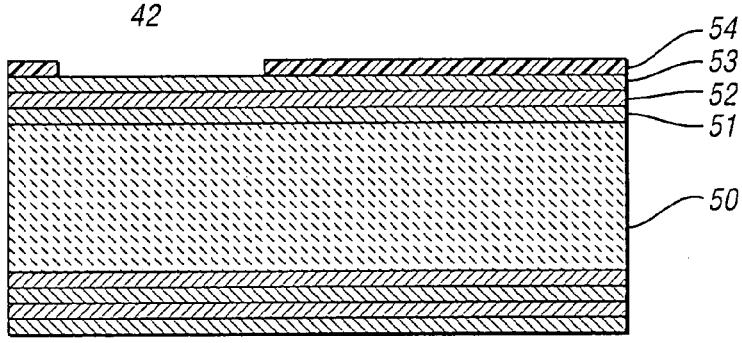

A bare silicon wafer 50 is coated with layers of $SiO_2$, $Si_3N_4$, $SiO_2$, 51, 52 and 53, respectively, and a 100 nm layer 54 of thick polysilicon. The polysilicon is patterned to define area for lead transfer and to define the narrow channels 16 (FIG. 5*c*).

Figure 5D:
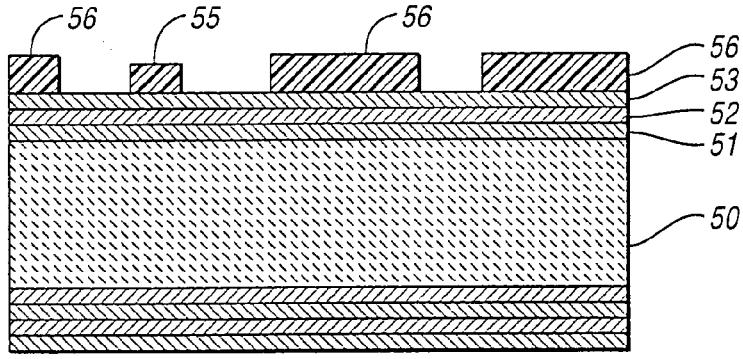

An additional 900 nm layer of polysilicon is deposited, doped, and annealed, creating regions of polysilicon 900 nm thick 55 and 1 μm thick 56. The full 1 μm thick polysilicon 56 is patterned to isolate regions defining the heater 22, the upper electrode of the capacitive pressure sensor, and regions for lead transfer (FIG. 5*d*).

Figure 5E:
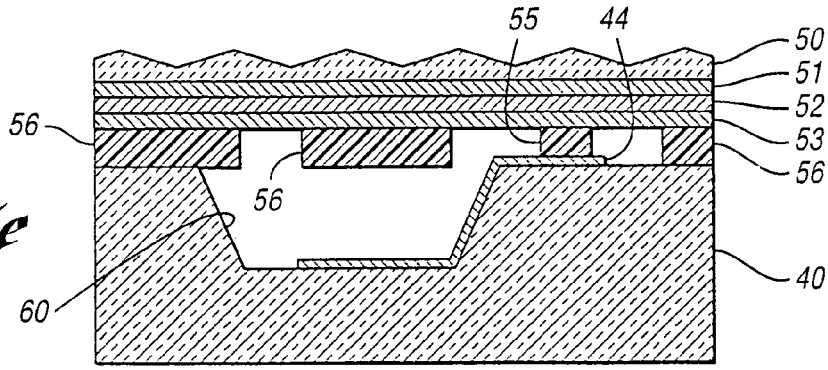

Referring to FIG. 5*e*, the glass and silicon wafers 40 and 50, respectively, are anodically bonded (through the polysilicon 56), creating sealed microcavities (one of which is shown at 60) and connecting the titanium electrode 44 on the glass substrate 40 to the polysilicon 55 on the silicon substrate 50. The narrow channels 16 are formed because the thinner polysilicon 55 (900 nm) does not touch the glass substrate 40, leaving a 100 nm thick channel 16 (FIG. 5*g*).

Figure 5F:
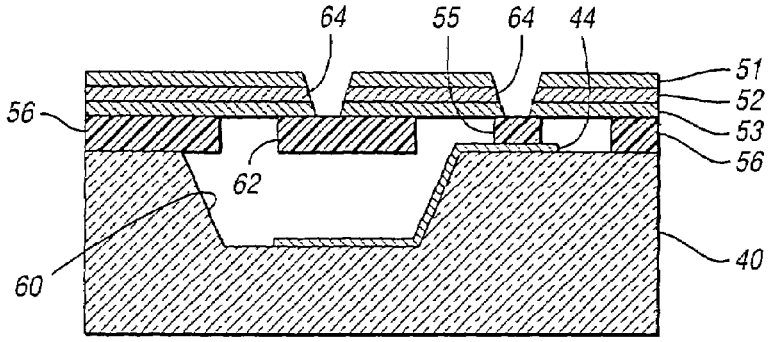
Figure 5G:
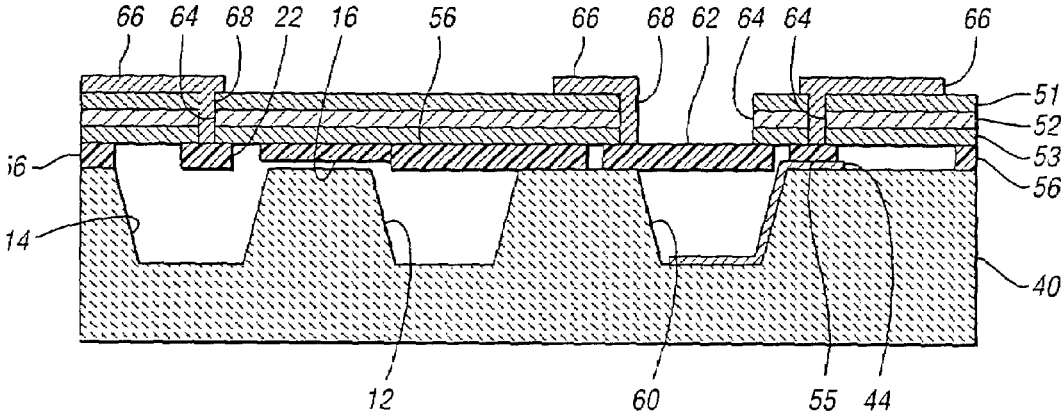
FIG. 5*g* is a side sectional, slightly enlarged view of a packaged Knudsen pump of the present invention showing hot and cold chambers connected by a narrow channel, and a capacitive pressure sensor used to measure the pump performance.

The entire silicon wafer 50 is dissolved, leaving cavities 60 sealed with dielectric/polysilicon diaphragms or membranes 62 (FIGS. 5*f* and 5*g*).

The substrate is also planar, permitting additional planar microfabrication techniques to be used and avoiding stress concentrations. The dielectric stack 51, 52 and 53 is selectively dry etched to form electrical vias 64 for interconnect to the polysilicon and to create the polysilicon membranes 62 for the pressure sensor (FIG. 5*f*).

Finally, titanium is deposited and patterned to define the top metal and bonding pads 66 (FIG. 5*g*). FIG. 5*g* is an expanded cross-section of the final device, showing a hot chamber 14 (left) connected to a cold chamber 12 (middle) via the narrow channel 16, and a capacitive pressure sensor formed by the lower electrode 44 and the diaphragm 62 on the right. The suspended bonding pad 66 minimizes parasitic capacitances and is also shown adjacent to the pressure sensor.

There are three levels of interconnect available in the finished device of FIG. 5*g*: a top metal level of the bonding pads 66, a suspended polysilicon layer 54 and 56, and a buried metal level of the electrode 44. The dielectric layers 51, 52 and 53 separate the top metal and bonding pads 66 and polysilicon 54 and 56. The polysilicon membrane 62 and buried metal electrode 44 are separated by an air gap. The dielectric cover formed by layers 51, 52 and 53 is selected to: (1) maximize thermal isolation, (2) provide a cover with a small gas permeation rate, and (3) minimize parasitic capacitances.

The cold chambers 12 and 20 are passively maintained at room temperature. The polysilicon heater 22 located near the narrow channels 16 heats the hot chamber 14. The polysilicon heater 22 is suspended on the thin dielectric membrane 53 in order to minimize heat flow from the heater 22 to the substrate 40. The glass substrate 40 is used to provide thermal insulation and, thereby, improve the energy efficiency. A long channel length is used to improve thermal isolation between the hot and cold chambers 14 and 12, respectively. Thin film bolometers 24 (only shown in FIG. 2) are located on the bottom of every chamber 12, 14 and 20, allowing the temperature distribution and thermal isolation to be measured.

The wide channels 18 are 10 μm deep and 30 μm wide. This ensures that the gas flow is in the viscous regime for pressures down to 300 Torr with a hot chamber temperature of 600° C. The narrow channels 16 are 10 μm wide and 100 nm deep, corresponding to a Knudsen number of 0.6. This is in the transition regime to provide a higher gas flow rate while maintaining operation at atmospheric pressure. A long channel is used to reduce the thermal gradient along the channel 16 and hence minimize power consumption, and multiple channels 16 are used in parallel to increase the flow rate.

A capacitive pressure sensor is located adjacent to every cold chamber 12, 20, as far away as possible from the hot chamber 14 to avoid unintended heating. The top electrode is a 1 μm thick, 200 μm diameter polysilicon membrane 62 and the bottom titanium electrode 44 is located at the bottom of a 10 μm recess 42 in the glass 40. Due to its small size, the sensitivity of the pressure sensor is limited in part by parasitic capacitances. To alleviate this problem, the bonding pads 66 are suspended on the dielectric layer 51 over a 1 μm air gap over the glass substrate 40, eliminating all electrically conductive materials from the vicinity of the bonding pad 66. The bonding pads 66 are sufficiently robust to permit testing and packaging.

Measurement Results

An optical micrograph and an SEM image of the same single-stage fabricated device before an outlet is formed for the pump is shown in reference [17]. At that time, the interior of the Knudsen pump is sealed under vacuum. The optical micrograph shows deflected pressure sensor diaphragms due to the ambient pressure, but the SEM image has flat diaphragms due to the vacuum ambient. The wide channel is etched 10 μm into the glass and has a dielectric cover. The narrow channel is 10 μm wide but only 100 nm high. The polysilicon did not bond to the glass substrate along the narrow channel despite the very small gap.

A bonding pad was formed that offers not only high thermal isolation, but also very low parasitic capacitance (measured at <1 fF) because it is suspended. The region under the bonding pad is sealed under vacuum, causing the observed deflection around the edges of the metal. Such features make this fabrication process attractive for capacitive sensors and RF Microsystems.

The operation of the Knudsen pump whose outlet is vented to atmosphere can be observed by watching the deflection of the vacuum cavity pressure sensor. The pressure sensor membrane is flat with no power to the Knudsen pump, but it is deflected with the power on. Finite element analysis was performed using ANSYS® to predict the response of the pressure sensor. The measured change in capacitance was 2.6 fF, which corresponds to a cavity pressure of 0.46 atm. The input power was 80 mW and the calculated heater temperature from eqn. (4) was ≈1100° C.

Using embedded bolometers, the bottom of the hot chamber was measured to rise by ≈10° C. with 35 mW of power to the polysilicon heater on the diaphragm above it, and a neighboring cold chamber rose ≈1° C. The temperature coefficient of resistance (TCR) of the polysilicon was measured to be −1213 ppm over a range up to 100° C. Assuming the TCR is constant over a much larger temperature range, the thermal isolation of a 1 mm long suspended polysilicon heater was found to be approximately $2\times10^5$ K/W. The thermal isolation of the Knudsen pump at 1100° C. (with a 250 μm long heater) was estimated to be $1.4\times10^4$ K/W. These thermal measurements prove that the pump should experience no loss of performance due to undesired heating of the cold chamber.

CONCLUSIONS

The above demonstrates not only that a single chip Knudsen pump 10 is feasible, but that it can operate at atmospheric pressure. Atmospheric operation, which has been reported only once before, is made possible by taking advantage of the small feature sizes achievable in microfabrication without using aggressive lithography. A single stage pump 10 and two integrated capacitive pressure sensors occupy an area 1.5 mm×2 mm. The pressure in a microcavity is 0.46 atm at 80 mW of input power. Multiple stages may be cascaded in series to create a pump with a lower ultimate pressure as shown in FIG. 3*a*.

Figure 6:
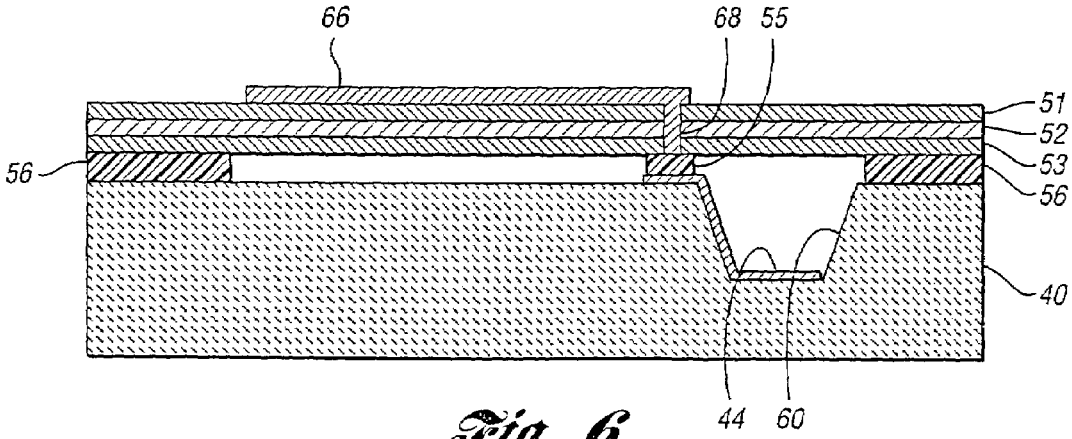
FIG. 6 is a side schematic view showing an electrical interconnect which interconnects a suspended bonding pad to a metal electrode formed within a recess in a substrate.

The fabrication process described herein has many features that make it applicable to other micromachined devices. The process is capable of creating narrow channels 16 with a hydraulic diameter of less than 100 nm, making it suitable for gas and liquid devices that require a small hydraulic diameter, such as the electro-osmotic flow pump. The high thermal isolation that was obtained (as high as $2\times10^5$ K/W) is suitable for isolating other temperature-dependent sensors and actuators, such as convection-based flow meters or micro-hotplates, from their surroundings and minimizing their power consumption. The suspended bonding pads 66 are ideally suited for all devices that use capacitive-based sensors because the parasitic capacitances are very small (<1 fF). Electrical lead-transfer or electrical interconnects 68, as shown in FIGS. 5*g* and 6, with low parasitic resistance (<1 Ω) and capacitance (<1 fF) may be made to the interior of a vacuum-encapsulated cavity using this process. Finally, the 6-mask process is silicon IC-compatible because only polysilicon, Si-dielectric materials, metal, and glass are needed.

Although the Knudsen pump was used to evacuate a cavity as described above, the larger goal was the demonstration of the concept. The concept may be implemented for gas sampling applications, pneumatic actuation, and vacuum encapsulation.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A packaged micromachined device including at least one narrow channel, the device comprising:

a substrate having an inner surface;

a cover having inner and outer surfaces and attached to the substrate; and at least one layer located between the inner surfaces to form the micromachined device including at least one narrow gas or liquid channel having a hydraulic diameter when the substrate and the cover are attached together, wherein the micromachined device includes a micropump having at least one stage wherein the micropump is a thermal transpiration micropump and wherein the device further comprises a plurality of sealed microchambers including first and second microchambers and wherein the at least one narrow channel communicates the first and second microchambers and wherein the micromachined device further comprises at least one micromachined structure for creating a temperature difference between first and second ends of the at least one narrow channel in order to generate a pumping effect.

2. The device as claimed in claim 1, wherein the hydraulic is sized so that the at least one narrow channel operates in either a free molecular flow regime or a viscous flow regime.

3. The device as claimed in claim 2, wherein the at least one narrow channel is sized to operate at atmospheric pressure.

4. The device as claimed in claim 1, wherein the at least one micromachined structure includes a heater suspended adjacent a first end of the at least one narrow channel and thermally isolated from the substrate.

5. The device as claimed in claim 4, wherein the heater is an electrically conductive heater suspended from the cover.

6. The device as claimed in claim 1, wherein a plurality of narrow channels fluidly communicate the sealed first and second microchambers.

7. The device as claimed in claim 1, wherein the substrate is a thermally insulating substrate for thermally isolating the micromachined device.

8. The device as claimed in claim 1, further comprising a microsensor disposed adjacent the first microchamber.

9. The device as claimed in claim 8, wherein the microsensor is a pressure sensor to sense pressure in the first microchamber.

10. The device as claimed in claim 9, wherein the pressure sensor is a capacitive pressure sensor at least partially disposed in one of the sealed microchambers.

11. The device as claimed in claim 10, wherein the capacitive pressure sensor includes a bottom electrode supported on the substrate and a top electrode formed from the at least one layer and suspended adjacent the bottom electrode.

12. The device as claimed in claim 1, wherein the sealed microchambers include a third microchamber and a wide channel fluidly communicating the third microchamber and the first microchamber and wherein the first, second and third microchambers and the wide and narrow channels define a stage of the micropump.

13. The device as claimed in claim 12, wherein pressure is lowered in the at least one narrow channel due to thermal transpiration and wherein pressure remains substantially constant in the wide channel.

14. The device as claimed in claim 12, further comprising a microsensor disposed adjacent the third microchamber.

15. The device as claimed in claim 14, wherein the microsensor is a pressure sensor to sense pressure in the third microchamber.

16. The device as claimed in claim 15, wherein the pressure sensor is a capacitive pressure sensor at least partially disposed in one of the sealed microchambers.

17. The device as claimed in claim 1, wherein the micropump is a vacuum micropump.

18. The device as claimed in claim 1, wherein the cover includes at least one dielectric layer.

19. The device as claimed in claim 1, further comprising a second micromachined structure located within one of the sealed microchambers, wherein the cover is an insulating cover which includes at least one hole formed therethrough between the inner and outer surfaces of the cover and a path of electrically conductive material electrically connecting the second micromachined structure with the outer surface of the cover through the at least one hole.

20. The device as claimed in claim 1, wherein the at least one micromachined layer bonds the cover to the substrate.

21. The device as claimed in claim 20, wherein the at least one layer anodically bonds the cover to the substrate.

22. A packaged micromachined device including at least one narrow channel, the device comprising:

a substrate having an inner surface;

a cover having inner and outer surfaces and attached to the substrate; and at least one layer located between the inner surfaces to form the micromachined device including at least one narrow gas or liquid channel having a hydraulic diameter when the substrate and the cover are attached together wherein two layers having different thicknesses are located between the inner surfaces and wherein the two layers and the inner surface of the substrate define a plurality of narrow gas or liquid channels.

23. The device as claimed in claim 22 wherein the micromachined device includes a micropump having at least one stage.

24. A packaged micromachined device including at least one narrow channel, the device comprising:

a substrate having an inner surface;

a cover having inner and outer surfaces and attached to the substrate; and at least one layer located between the inner surfaces to form the micromachined device including at least one narrow gas or liquid channel having a hydraulic diameter when the substrate and the cover are attached together wherein the micromachined device includes a micropump having at least one stage wherein structures forming the at least one channel are either <5 μm thick or have <10 W/mK thermal conductivity.

25. A packaged micromachined device including at least one narrow channel, the device comprising:

a substrate having an inner surface;

a cover having inner and outer surfaces and attached to the substrate; and at least one layer located between the inner surfaces to form the micromachined device including at least one narrow gas or liquid channel having a hydraulic diameter when the substrate and the cover are attached together wherein the cover is an insulating cover and wherein the cover includes a first hole formed therethrough between the inner and outer surfaces of the cover and a first path of electrically conductive material electrically connecting the outer surface of the cover to the micromachined device through the first hole.

26. The device as claimed in claim 25, wherein the micromachined device includes a heater and wherein the electrically conductive material electrically connects the heater and the outer surface of the cover through the first hole.

27. The device as claimed in claim 25, wherein the cover includes a second hole formed therethrough between the inner and outer surfaces of the cover and a second path of electrically conductive material and wherein the device further comprises a microsensor and wherein the second path of electrically conductive material electrically connects the microsensor and the outer surface of the cover through the second hole.

28. The device as claimed in claim 25 further comprising an electrically conductive layer formed on the outer surface of the cover, the first path of electrically conductive material electrically connecting the electrically conductive layer to the micromachined device.

29. The device as claimed in claim 28, wherein the dielectric cover thermally isolates the electrically conductive layer.

30. The device as claimed in claim 28, wherein the insulating cover reduces parasitic capacitance.

31. A packaged micromachined device including at least one narrow channel, the device comprising:

a substrate having an inner surface;

a cover having inner and outer surfaces and attached to the substrate; and at least one layer located between the inner surfaces to form the micromachined device including at least one narrow gas or liquid channel having a hydraulic diameter when the substrate and the cover are attached together wherein the at least one layer forms part of a microsensor.

32. A packaged micromachined device including at least one narrow channel, the device comprising:

a substrate having an inner surface;

a cover having inner and outer surfaces and attached to the substrate; and at least one layer located between the inner surfaces to form the micromachined device including at least one narrow gas or liquid channel having a hydraulic diameter when the substrate and the cover are attached together wherein the at least one layer is electrically conductive.

* * * * *